US012018218B2

(12) United States Patent
Hu

(10) Patent No.: US 12,018,218 B2
(45) **Date of Patent: *Jun. 25, 2024**

(54) HYDROCRACKING PROCESS FOR MAKING MIDDLE DISTILLATE FROM A LIGHT HYDROCARBON FEEDSTOCK

(71) Applicant: SHELL OIL COMPANY, Houston, TX (US)

(72) Inventor: Michael Chiun-Kuei Hu, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/419,771

(22) Filed: May 22, 2019

(65) Prior Publication Data

US 2019/0359900 A1 Nov. 28, 2019

Related U.S. Application Data

(60) Provisional application No. 62/676,398, filed on May 25, 2018.

(51) Int. Cl.
*C10G 67/02* (2006.01)
*C10L 1/08* (2006.01)

(52) U.S. Cl.
CPC ..... *C10G 67/02* (2013.01); *C10L 1/08* (2013.01); *C10G 2300/107* (2013.01); *C10G 2300/202* (2013.01); *C10G 2300/301* (2013.01); *C10G 2300/70* (2013.01); *C10G 2400/04* (2013.01); *C10L 2270/026* (2013.01); *C10L 2290/543* (2013.01)

(58) Field of Classification Search
CPC ..... C10G 47/16; C10G 47/36; C10G 65/02; C10G 65/10; C10G 65/12; C10G 2300/1059
See application file for complete search history.

(56) References Cited

U.S. PATENT DOCUMENTS

| | | | | |
|---|---|---|---|---|
| 3,726,788 | A | 4/1973 | Trythall | |
| 3,816,296 | A | 6/1974 | Hass et al. | |
| 6,190,538 | B1 * | 2/2001 | Gosselink | B01J 29/80 208/111.01 |
| 7,048,845 | B2 | 5/2006 | Bauer | |
| 7,192,900 | B2 | 3/2007 | Creyghton et al. | |
| 7,247,235 | B2 | 7/2007 | Virdi et al. | |
| 7,749,373 | B2 | 7/2010 | Hansen et al. | |
| 8,318,006 | B2 | 11/2012 | Benazzi et al. | |
| 8,888,990 | B2 | 11/2014 | Zimmerman | |
| 2003/0085154 | A1 * | 5/2003 | Benazzi | C10G 65/12 208/89 |

(Continued)

OTHER PUBLICATIONS

Office Action Received for Russian Application No. 2020138351, Mailed on Oct. 18, 2022, 15 Pages(7 Pages of English Translation and 8 Pages of Official Copy).

(Continued)

*Primary Examiner* — Prem C Singh
*Assistant Examiner* — Brandi M Doyle
(74) *Attorney, Agent, or Firm* — SHELL USA, INC.

(57) ABSTRACT

A two-stage hydrocracking process for preferentially making a high-quality middle distillate product such as diesel from a relatively light hydrocarbon feedstock such as light vacuum gas oil.

10 Claims, 1 Drawing Sheet

(56) References Cited

U.S. PATENT DOCUMENTS

| | | | | |
|---|---|---|---|---|
| 2007/0084751 | A1* | 4/2007 | Wang | C10G 47/16 208/59 |
| 2009/0100746 | A1 | 4/2009 | Lopez et al. | |
| 2013/0264246 | A1 | 10/2013 | Holtzer et al. | |
| 2014/0022941 | A1 | 1/2014 | Apte et al. | |
| 2015/0159095 | A1* | 6/2015 | Zhan | C10G 47/18 208/95 |

OTHER PUBLICATIONS

Office Action Received for Russian Application No. 2020138349, Mailed on Oct. 18, 2022, 15 Pages(7 Pages of English Translation and 8 Pages of Official Copy).

International Search Report and Written Opinion Received for PCT Application No. PCT/US2019/033585, mailed on Aug. 13, 2019, 09 pages.

International Search Report and Written Opinion Received for PCT Application No. PCT/US2019/033567, mailed on Aug. 13, 2019, 10 pages.

* cited by examiner

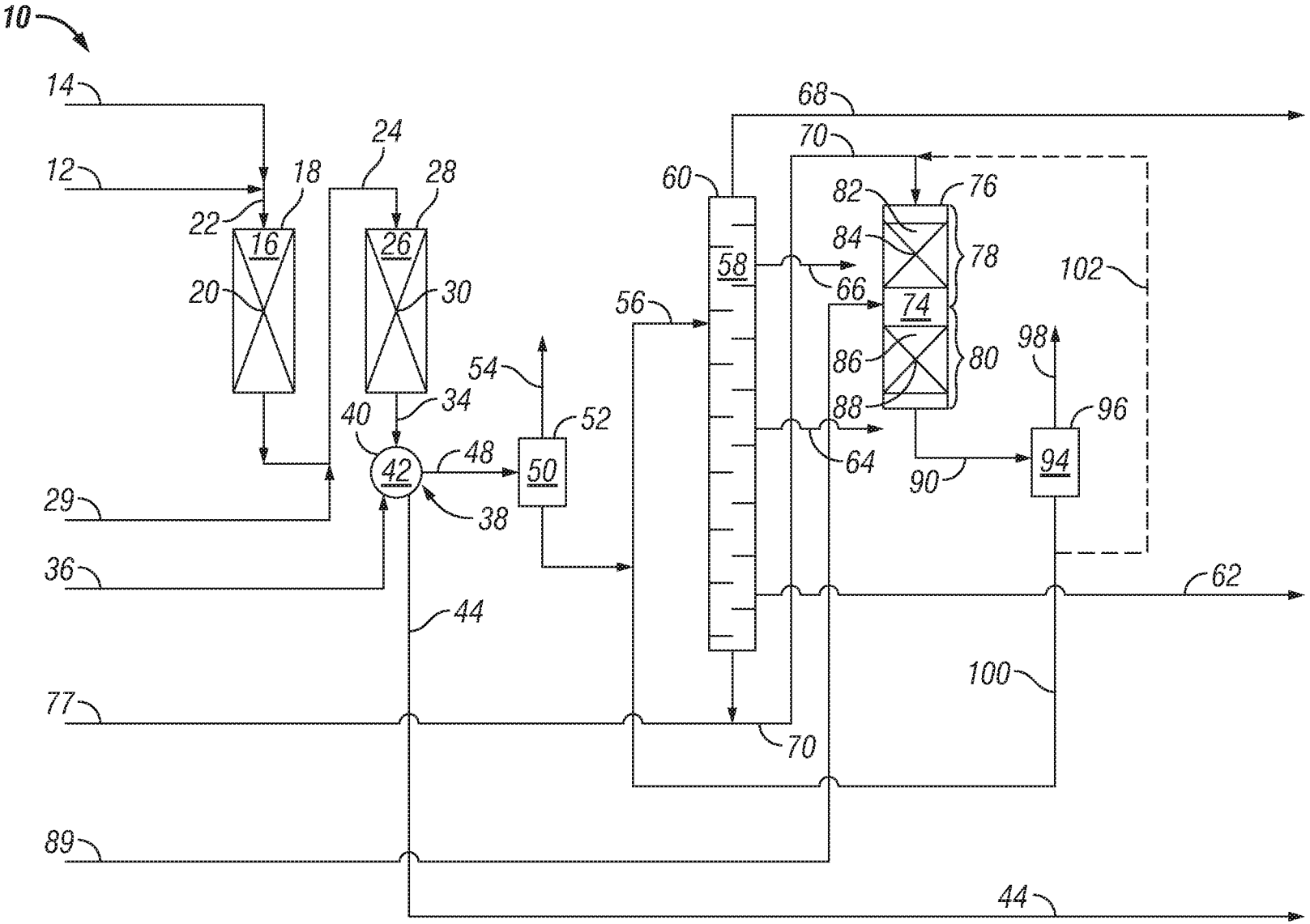
10
14
12
29
36
77
89
16
18
22
20
24
26
28
30
34
42
40
38
48
50
52
54
56
58
60
68
70
66
64
82
84
86
88
74
76
78
80
90
94
96
98
102
62
100
44

HYDROCRACKING PROCESS FOR MAKING MIDDLE DISTILLATE FROM A LIGHT HYDROCARBON FEEDSTOCK

CROSS-REFERENCE TO RELATED APPLICATION

This application claims the benefit of U.S. Provisional Patent Application 62/676,398 filed May 25, 2018 entitled A HYDROCRACKING PROCESS FOR MAKING MIDDLE DISTILLATE FROM A LIGHT HYDROCARBON FEEDSTOCK, the entirety of which is incorporated by reference herein.

FIELD OF THE INVENTION

This invention relates to a hydrocracking process for preferentially making middle distillate such as diesel from a relatively light hydrocarbon feedstock such as light vacuum gas oil.

BACKGROUND

Refineries commonly apply hydrocracking processes to convert high boiling hydrocarbon feedstocks to produce more valuable products such as naphtha and the middle distillates. The hydrocracking process also can provide for removal of organic sulfur and organic nitrogen from the feedstocks by application of a hydrotreating step that is a part of an overall hydrocracking process.

Hydrocracking is generally carried out by contacting gas oil or other heavy hydrocarbon feedstocks with a hydrocracking catalyst contained within a reaction vessel in the presence of hydrogen gas under elevated reaction temperatures and pressures to yield lighter, more valuable hydrocarbon products. These products typically boil within the gasoline boiling range of from 85° C. (185° F.) to 215° C. (419° F.) and the middle distillate boiling range of from 150° C. (302° F.) to 425° C. (797° F.). The hydrocracking catalyst typically includes a hydrogenation metal component, crystalline aluminosilicate material such as X-type and Y-type zeolite, and a refractory inorganic oxide such as silica, alumina, or silica-alumina.

The hydrocracking process typically includes a pretreating step followed by a hydrocracking step or, with some processes, two hydrocracking steps. The pretreating step provides for hydrodesulfurization and hydrodenitrogenation of the organo sulfur and organonitrogen compounds in the hydrocarbon feedstock to convert them by hydrogenation to hydrogen sulfide and ammonia. The pretreating catalyst typically includes a Group VIII metal component and a Group VI metal component supported or combined with an inorganic oxide matrix material.

One type of two-stage hydrocracking process is disclosed in U.S. Pat. No. 3,726,788. This two-stage process includes two fractionation steps and two hydrocracking stages to process a highly aromatic hydrocarbon feedstock to obtain a high-aromatic naphtha product and a low-aromatic turbine fuel product. The first hydrocracking stage is carried out in the presence of hydrogen sulfide and ammonia in order to suppress the hydrogenation of aromatics. The presence of ammonia in the first hydrocracking stage feed acts to inhibit the hydrocracking catalyst activity that results in suppressing the hydrogenation of aromatics. A combination of a flash separation and a first stage fractionation is intermediate between the first hydrocracking stage and the second hydrocracking stage.

The combination of flash and fractionation separations provides a high boiling, high aromatics hydrocarbon stream having a low concentration of ammonia and hydrogen sulfide that is mixed with hydrogen treat gas, which contains little or no ammonia but has a controlled concentration of hydrogen sulfide. This mixed stream is introduced into the second hydrocracking stage. The controlled concentration of hydrogen sulfide of the hydrogen treat gas suppresses hydrogenation of aromatics. This hydrogen sulfide concentration is controlled also to provide for low aromatic naphtha and low aromatic turbine fuel products that meet desired aromatics specifications.

There is no suggestion that the two-stage hydrocracking process of the '788 patent can provide for easy processing of a light gas oil feedstock that selectively produces middle distillate and, specifically, produces high quality, low-sulfur diesel. The process of the '788 patent requires use of two fractionation steps with the first fractionation step intermediate between the two hydrocracking stages. The first stage fractionator bottoms of the process of the '788 patent is introduced into the second stage hydrocracking reactor, and it is not passed to the second stage fractionator. It further is noted that there is no suggestion by the '788 patent of the use of stacked beds of different types of functional catalysts providing for the selective production of middle distillate and providing for operating flexibility.

Another two-stage hydrocracking process is disclosed in U.S. Pat. No. 3,816,296. This process provides for hydrocracking heavy hydrocarbons boiling above 700° F. to selectively produce midbarrel fuels boiling between 300° F. and 700° F. and lower boiling products such as gasoline or naphtha fractions. The yield of these products for a given hydrocracking conversion is controlled and changed as desired by the controlled addition of certain nitrogen-containing compounds to the second-stage hydrocracking zone of the process. The nitrogen compounds include ammonia and other nitrogen-containing compounds convertible to ammonia in the hydrocracking zone.

The midbarrel hydrocracking catalyst of the process of the '296 patent comprises refractory oxide support that is at least about 50 weight percent amorphous alumina, has less than 30 weight percent crystalline zeolite, and a hydrogenation active component.

The process of the '296 patent includes a high-pressure scrubber-separator and a fractionator positioned between an initial hydrocracking reaction stage and the second hydrocracking reaction stage. The effluent from the initial hydrocracking reaction stage passes to the high-pressure scrubber-separator that provides for water scrubbing the effluent to remove ammonia and hydrogen sulfide. The scrubbed effluent passes to the fractionator, which separates it into gasoline range hydrocarbons boiling below 400° F., midbarrel fuels boiling between the gasoline cut point and about 700° F., and unconverted hydrocarbons boiling above about 700° F. The nitrogen compounds are added to the unconverted hydrocarbons that are passed to the second hydrocracking reaction stage. The effluent from the second hydrocracking reaction stage is passed to a separator and the separated liquid is recycled to the fractionator.

A required feature of the process of the '296 patent is the use of a fractionation step between the first stage hydrocracking reactor and the second stage hydrocracking reactor. There is no suggestion of the use of stacked beds of different types of functional catalyst providing for the selective production of middle distillate and providing for operating flexibility. The use of quench gas to assist in control of the reaction temperatures of the hydrocracking reaction stages is not recognized by the '296 patent.

Another patent, U.S. Pat. No. 8,318,006, discloses a once-through hydrocracking process. A feature of this process is an intermediate hot flash step placed between a hydrorefining step and a hydrocracking step. The intermediate hot flash provides for the separation of at least a portion of the ammonia from the effluent leaving the hydrorefining step. There is no distillation of the liquid effluent from the intermediate hot flash step before its introduction into the second reaction step of the process. The second reaction zone preferably comprises at least one bed of hydrorefining catalyst upstream of at least one bed of hydrocracking catalyst. There is no disclosure by the '006 patent of the use of quench gas to control hydrocracking reaction temperature within the second reaction zone. Controlling the quantity of ammonia admitted to the hydrocracking step increases the flexibility of the process and provides for improvement in the middle distillate selectivity of the hydrocracking catalyst.

It is sometimes desirable to process light gas oil feedstocks that are only slightly heavier than diesel fuel in a hydrocracking unit to preferentially yield diesel instead of naphtha or gasoline. It can be difficult, however, to hydrocrack gas oil that is only slightly heavier than diesel to make a high-quality diesel product, because their boiling temperatures can overlap which makes it difficult to control the amount of cracking to yield diesel instead of naphtha or gasoline.

Also, market economics sometimes make it beneficial to change the operation of a hydrocracking unit from a gasoline production operating mode to a distillate or diesel production operating mode. Thus, hydrocracker unit operating flexibility can be important to maximizing its operating economics. When operating a hydrocracking unit in a diesel production mode, the diesel product should be high quality, such as having low aromatics content and high cetane number, and also it should meet ultra-low sulfur diesel specifications. Thus, it is important for the hydrocracking unit to include features providing for its operation to make high quality, ultra-low sulfur diesel.

SUMMARY

Accordingly, provided is a hydrocracking process for converting a light gas oil feedstock to produce a diesel product. In this process, the light gas oil feedstock is introduced into a first reaction zone defined by a first reactor and containing a first pretreating catalyst, and a first reactor effluent is yielded from the first reaction zone. The first reactor effluent is introduced into a second reaction zone defined by a second reactor and containing a first hydrocracking catalyst, and a second reactor effluent is yielded from said second reaction zone. The second reactor effluent is introduced into a first separation zone defined by a first separator vessel providing means for separating the second reactor effluent into a first separator vapor and a first separator liquid. The first separator liquid introduced into a fractionator providing for the distillation separation of the first separated liquid to yield at least a bottoms product and another product. The bottoms product is introduced into a third reaction zone defined by a third reactor, wherein within the third reaction zone is included a top bed comprising a second pretreating catalyst and a bottom bed comprising a second hydrocracking catalyst. A third reactor effluent is yielded from the third reaction zone and introduced into a second separation zone defined by a second separator vessel providing means for separating the third reactor effluent into a second separator vapor and a second separator liquid. The second separated liquid is introduced into the fractionator.

BRIEF DESCRIPTION OF THE DRAWINGS

The FIGURE presents a process flow diagram of one embodiment of the inventive two-stage hydrocracking for converting a hydrocarbon feedstock to preferentially yield middle distillate.

DETAILED DESCRIPTION

The invention relates to a two-stage hydrocracking process for converting a light gas oil feedstock to selectively, or preferentially, yield middle distillate products, and, particularly, ultra-low sulfur diesel. The inventive process includes elements and features that provide for flexible operation of the two-stage hydrocracking process between a naphtha production operating mode and a diesel production operating mode. The process further provides for hydrocracking a light gas oil feedstock having a boiling range overlapping the boiling range of diesel but shifted such that it is slightly higher than the boiling range of diesel. This feedstock is relatively lighter than most typical gas oil feedstocks processed by hydrocracker units; and, because of this, it is more difficult to process to selectively yield diesel instead of gasoline and to yield a good quality diesel product such as ultra-low sulfur diesel.

The light gas oil feedstock may be from any hydrocarbon source, for example, petroleum crude oil. It is typically an atmospheric distillate or a light vacuum distillate of petroleum crude oil. The light gas oil feedstock may be characterized as having an initial boiling temperature greater than about 135° C. (275° F.) and a final boiling temperature of less than about 440° C. (824° F.). More specifically, the temperature at which 10 volume percent of the light gas oil is recovered using the distillation testing method ASTM D-86, i.e., T(10), is greater than or about 135° C. (275° F.), preferably, greater than 150° C. (302° F.), and, most preferably, greater than or about 165° C. (329° F.). The temperature at which 90 volume percent of the light gas oil is recovered using the distillation testing method ASTM D-86, i.e., T(90), is less than or about 424° C. (797° F.), preferably, less than or about 400° C. (752° F.), and, more preferably, less than or about 375° C. (707° F.).

The sulfur content of the light gas oil feedstock is generally in the range of upwardly 5 weight percent of the feedstock. It is more typically in the range of from 0.1 wt. % to 5 wt. %, and, most typically, from 0.5 wt. % to 4 wt. % or 0.75 wt. % to 3 wt. %. The sulfur content may be determined by the testing method ASTM D 5453 or any other suitable or comparable testing method.

The nitrogen content of the light gas oil feedstock is normally greater than 500 parts per million by weight (ppmw) and usually in the range of from 500 ppmw to 5,000 ppmw. More typically, the nitrogen content of the light gas oil feedstock is in the range of from 700 ppmw to 4,000 ppmw. The nitrogen content may be determined by the testing method ASTM D5762 or any other suitable or comparable testing method.

The diesel product provided by the inventive hydrocracking process has a significantly reduced sulfur content over that of its light gas oil feedstock. The process will typically provide a diesel product having a sulfur content that is less than 50 ppmw, and, preferably, the sulfur content is less than 10 ppmw. The nitrogen content is significantly reduced as well. The nitrogen content of the diesel product is typically reduced to less than 50 ppmw, and it usually is in the range of from 1 to 10 ppmw.

The middle distillates yielded from the inventive hydrocracking process can include kerosene and diesel. While it is not preferred, the process may also yield a product boiling within the naphtha boiling range. It is preferred, however, to operate the process in a diesel production mode to preferentially yield and produce a diesel product. Indeed, one aspect of the inventive process is that it provides for the selective production of diesel as opposed to kerosene and naphtha.

The diesel product of the process is characterized as having an initial boiling temperature between 125° C. (257° F.) and 150° C. (302° F.) and a final boiling temperature between 370° C. (698° F.) and 400° C. (752° F.). It is preferred for the diesel product to have a T(90) temperature in the range of from 282° C. (540° F.) to 338° C. (640° F.).

The first step of the inventive process (process) includes passing the light gas oil feedstock (feedstock) to the first reactor of the process unit and introducing it along with added hydrogen gas into the first reaction zone defined by the first reactor. Contained within the first reaction zone is a bed of first pretreating catalyst with which the feedstock is contacted in the presence of the hydrogen gas under suitable hydrotreating (i.e., hydrodesulfurization and hydrodenitrogenation) reaction conditions sufficient to convert a significant portion of the organic sulfur compounds of the feedstock to hydrogen sulfide and a significant portion of the organic nitrogen compounds of the feedstock to ammonia.

The first pretreating catalyst may be any known hydrotreating catalyst that suitably provides for the hydrodesulfurization and hydrodenitrogenation of the feedstock. Generally, the first pretreating catalyst comprises an inorganic oxide support material, such as alumina, silica, and silica-alumina, and a hydrogenation metal component. The hydrogenation metal may be a Group VIII metal (nickel or cobalt) or a Group VI metal (molybdenum or tungsten) or any combination thereof. Typically, the Group VIII metal is present in the first pretreating catalyst at a concentration in the range of from 1 to 20 weight percent, based on the oxide and total weight of the catalyst, and the Group VI metal is present at a concentration in the range of from 1 to 20 weight percent, based on the oxide and the total weight of the catalyst. Various of the hydrorefining catalysts disclosed and described in U.S. Pat. No. 8,318,006 may suitably be used as the first pretreating catalyst of the process. U.S. Pat. No. 8,318,006 is incorporated herein by reference.

The hydrotreating reaction conditions under which the first reaction zone is operated include a hydrotreating temperature in the range of from about 550° F. to about 850° F. and a hydrotreating pressure in the range of from about 1400 psi to 2000 psi. The liquid hourly space velocity (LHSV) is in the range of from about 0.1 $hr^{-1}$ to 10 $hr^{-1}$. The hydrogen treat gas rate is in the range of from about 500 scf per barrel of feedstock to about 8000 scf per barrel of feedstock. The hydrotreating reaction conditions within the first reaction zone are controlled to obtain a conversion of from 95 to 99.9 weight percent of the organic sulfur in the feedstock to hydrogen sulfide and from 95 to 99.9 weight percent of the organic nitrogen in the feedstock to ammonia.

A first reactor effluent is yielded from the first reaction zone of the first reactor. The first reactor effluent passes from the first reaction zone and is introduced along with added hydrogen gas into the second reaction zone defined by a second reactor. Contained within the second reaction zone is a bed of first hydrocracking catalyst with which the first reactor effluent is contacted in the presence of the hydrogen gas under suitable hydrocracking reaction conditions sufficient to provide a desired amount of hydrocracking of the first reactor effluent.

The first hydrocracking catalyst may be any known hydrocracking catalyst that suitably provides for the desired first stage cracking of the first reactor effluent. Generally, the first hydrocracking catalyst comprises a zeolite component, an inorganic oxide component, and a hydrogenation metal component.

Various zeolites that may be suitable components of the first hydrocracking catalyst include, for example, zeolite X, zeolite Y, zeolite beta, and ZSM-5. The zeolite component may be present in the first hydrocracking catalyst in an amount up to about 80 wt. % of the catalyst.

The inorganic oxide component may be selected from the group consisting of alumina, silica, titania, silica-alumina and combinations thereof, and it is present in the first hydrocracking catalyst in an amount exceeding 25 wt. % of the catalyst.

The hydrogenation metal component includes nickel or cobalt, or both, that may be present in the first hydrocracking catalyst in an amount in the range of from about 1 to 10 wt. % of the catalyst. The hydrogenation metal component further may include tungsten or molybdenum, or both, and, if present, the amount present in the first hydrocracking catalyst is in the range of from 5 to 25 wt. % of the catalyst. The first hydrocracking catalyst may also include a combination of either nickel or cobalt with either molybdenum or tungsten.

Various of the hydrocracking catalysts disclosed and described in U.S. Pat. No. 8,318,006 may suitably be used as the first hydrocracking catalyst. Other possible hydrocracking catalyst compositions are disclosed and described in U.S. Pat. Nos. 7,749,373, 7,192,900, and 7,048,845. These patents are incorporated herein by reference.

The hydrocracking reaction conditions under which the second reaction zone is operated include a hydrocracking temperature in the range of from about 550° F. to about 850° F. and a hydrocracking pressure in the range of from about 1400 psi to 2000 psi. The liquid hourly space velocity (LHSV) is in the range of from about 0.1 $hr^{-1}$ to 10 $hr^{-1}$. The amount of hydrogen mixed with the first reactor effluent is in the range of from about 500 to about 8000 scf per barrel of first reactor effluent introduced into the second reaction zone. The hydrocracking reaction conditions within the second reaction zone are controlled to obtain a desired conversion of the first reactor effluent.

A second reactor effluent is yielded from the second reaction zone of the second reactor and passed to a water wash step. In the water wash step, the second reactor effluent is mixed with wash water that provides for removing at least a portion of the ammonia and hydrogen sulfide contained in the second reactor effluent. Separation of the water phase comprising the removed ammonia and hydrogen sulfide occurs within a separation zone defined by a separator vessel providing means for separating the mixture of wash water and second reactor effluent to yield a second reactor effluent, having been scrubbed of ammonia and hydrogen sulfide, and a water phase, containing ammonia and hydrogen sulfide.

The scrubbed second reactor effluent is then passed and introduced into a first separation zone defined by a first separator vessel. The first separator vessel provides means for separating the second reactor effluent into a first separator vapor, which comprises hydrogen gas as a major portion of the first separator vapor, and a first separator liquid. The first separation zone is operated under high pressure conditions that preferably approximate the operating pressure of the second reaction zone. Typically, the phase separation within the first separation zone is a single-stage, gravitational, vapor-liquid phase separation.

The first separator liquid passes and is introduced into the fractionation zone of a fractionation column providing means for distillation separation of the first separator liquid to yield a heavy bottoms product and one or more products that include a final diesel product of the inventive process. Other possible product streams from the fractionation column may include an overhead product, comprising light paraffins, a naphtha product, and a kerosene product. The kerosene product is characterized as having a maximum T(10) of 205° C. (401° F.) and a maximum end point of 300° C. (572° F.). The naphtha product may include hydrocarbons having boiling temperatures in the range of from about 40° C. (104° F.) to 220° C. (428° F.). The fractionator column may be any suitable equipment or design known to or designable by those skilled in the art of distillation.

The heavy bottoms product of the fractionation column comprises predominately hydrocarbons having boiling temperatures greater than 371° C. (700° C.). This heavy bottoms product is passed as a feed and introduced into a third reaction zone defined by a third reactor.

It is an essential feature of the process for the third reaction zone to include stacked beds of catalyst instead of a single catalyst bed. It further is a feature of the third reaction zone that its upper portion includes a top bed of second pretreating catalyst instead of hydrocracking catalyst and that its lower portion includes a bottom bed of second hydrocracking catalyst.

The placement of the second pretreating catalyst into the upper portion of the third reaction zone provides several benefits in the overall operation of the inventive hydrocracking process. One such benefit is that it allows for greater flexibility in operating the inventive hydrocracking process to selectively make a high-quality diesel product. It does this by helping to control the hydrocracking temperature within the bottom bed of second hydrocracking catalyst in the lower portion of the third reaction zone. The top bed that comprises the second pretreating catalyst fills up a portion of the third reaction zone with catalyst having no or little hydrocracking function resulting in less total hydrocracking catalyst contained within the third reactor and providing less hydrocracking than that which would be provided by a reactor vessel full of a hydrocracking catalyst. This reduction in the amount of hydrocracking is required due to the processing of a light gas oil feedstock, as defined herein, to selectively yield a diesel product instead of light naphtha and kerosene products.

Another benefit from the placement of the second pretreating catalyst in the third reaction zone as a top bed is that provides it provides for hydrogenation of organic sulfur and organic nitrogen compounds that were not hydrogenated in the first step of the process and that remain in the first separator liquid. The hydrogenation of these compounds yields small amounts of ammonia and hydrogen sulfide. The ammonia tends to suppress the hydrocracking activity of the second hydrocracking catalyst and provide for better diesel yield. Meanwhile, the additional hydrogenation of aromatic compounds would further enhance other diesel qualities such as ultra-low aromatic content and high cetane number. The inventive process provides for overall diesel yields that are higher than those of typical prior art hydrocracker configurations due to its improved hydrogenation and product volume swell.

The total volume of the third reaction zone defined by the third reactor vessel includes a top bed volume of the second pretreating catalyst and bottom bed volume of the second hydrocracking catalyst. The ratio of top bed volume-to-bottom bed volume within the third reaction zone should be within the range of 0.1:1 to 1.5:1. Preferably, this volumetric ratio is in the range of from 0.2:1 to 1.2:1, and, most preferably, the ratio of top bed volume-to-bottom bed volume is in the range of from 0.5:1 to 1.0:1. The volume of each catalyst bed may be represented by the cross-sectional area of the catalyst bed multiplied by the height of the catalyst bed.

The second pretreating catalyst is any known hydrotreating catalyst that suitably provides for the hydrodesulfurization and hydrodenitrogenation of the first separator liquid in accordance with the invention. The second pretreating catalyst may be the same or similar to the first pretreating catalyst as described above and may comprise an inorganic oxide support material, such as alumina, silica, and silica-alumina, and a hydrogenation metal component. The hydrogenation metal component may be either nickel or cobalt that may or may not be combined with molybdenum or tungsten, or both. The nickel or cobalt metal component is present in the second pretreating catalyst at a concentration in the range of from 1 to 20 weight percent, based on the oxide and the total weight of the catalyst, and the molybdenum or tungsten component, when present, is at a concentration in the range of from 1 to 20 weight percent, based on the oxide and the total weight of the catalyst.

The cracking reaction within the bottom bed is further controlled by the introduction of lower temperature quench gas into the third reaction zone to control the cracking reaction temperature within the bottom bed. The quench gas comprises hydrogen gas and has a temperature significantly below the temperature within the third reaction zone, and, in particular, within its bottom bed. Control of the diesel selectivity of the cracking reaction is assisted by controlling the cracking temperature within the bottom bed.

Additional control of the temperature within the bottom bed of the third reaction zone to control the diesel selectivity of the cracking reaction therein is achieved by admixing with the first separator liquid a nitrogen-containing compound selected from the group consisting of ammonia and organic amine compounds capable of conversion to ammonia under the conditions within the third reaction zone. The organic amine compounds preferably are selected from primary, secondary and tertiary alkyl amines having from one to 15 carbon atoms per molecule. One non-limiting example of a suitable alkyl amine is tributylamine. The amount of the nitrogen-containing compound added to the first separator liquid is such as to provide a nitrogen concentration in the first separator liquid hydrocarbon in the range of from 1 to 1,000 ppmw, preferably, from 5 to 500 ppmw, and, most preferably, from 10 to 200 ppmw. The ammonia compounds will have minimum effect on the performance and activity of the top bed hydrotreating catalyst.

In an embodiment of the inventive hydrocracking process, diesel selectivity and product quality can be improved by using a specific catalyst composition as the second hydrocracking catalyst of the bottom bed of the third reactor. In this embodiment, the second hydrocracking catalyst comprises less than 60 wt. % amorphous alumina, greater than 30 wt. % crystalline zeolite, and a catalytic metal component. The zeolite and catalytic metal components of the second hydrocracking catalyst may be the same as those mentioned above with respect to the first hydrocracking catalyst.

The reaction conditions within the third reaction zone include a third reactor temperature in the range of from about 550° F. to about 850° F. and a third reactor pressure in the range of from about 1400 psi to 2000 psi. The liquid hourly space velocity (LHSV), based on the volume of the second hydrocracking catalyst, is in the range of from about 0.1 $hr^{-1}$ to 10 $hr^{-1}$. The amount of hydrogen mixed with the first separator liquid is in the range of from about 500 to about 8000 scf per barrel of first separator liquid introduced into the third reaction zone. The reaction conditions within the third reaction zone are controlled to obtain a desired quality and yield of diesel product.

A third reactor effluent is yielded from the third reaction zone and introduced into a second separation zone defined by a second separator vessel. The second separator vessel provides means for separating the third reactor effluent into a second separator vapor, which comprises hydrogen gas as a major portion of the second separator vapor, and a second separator liquid. The second separation zone is operated under high pressure conditions that preferably approximate the operating pressure of the third reaction zone. Typically, the phase separation within the second separation zone is a single-stage, gravitational, vapor-liquid phase separation.

The second separator liquid, in one embodiment of the inventive process, is recycled and introduced as feed to the fractionation zone of the fractionation column. In an alternative embodiment of the invention, the second separator liquid is instead recycled and introduced as feed to the third reaction zone of the third reactor. In still another alternative, a portion of the second separator liquid passes and is introduced into the fractionation zone of the fractionation column, and a separate portion of the second separator liquid is recycled and introduced as a feed to the third reaction zone of the third reactor.

The FIGURE presents a process flow diagram of one embodiment of the inventive two-stage hydrocracking process 10 that is provided for illustration. In two-stage hydrocracking process 10, a light gas oil feedstock passing through line 12 is mixed with hydrogen gas that is introduced into the light gas oil feedstock by way of line 14. The mixture of light gas oil feedstock and hydrogen gas passes and is introduced into first reaction zone 16, which is defined by first reactor 18 and contains first pretreating catalyst 20, by way of line 22.

First reaction zone 16 is operated under suitable hydrotreating reaction conditions to provide a first reactor effluent that passes from first reaction zone 16 by way of line 24 and is introduced into second reaction zone 26. Second reaction zone 26 is defined by second reactor 28 that contains first hydrocracking catalyst 30.

Second reaction zone 26 is operated under hydrocracking conditions suitable for providing a desired conversion of the first reactor effluent to yield a second reactor effluent. Second reactor effluent passes from second reaction zone 26 by way of line 34 and is mixed with wash water that passes by way of line 36 into a water washing system 38. Water washing system 38 includes separator vessel 40 that defines separation zone 42. Separator vessel 40 provides means for separating the mixture of wash water and second reactor effluent to yield a second reactor effluent having been scrubbed of ammonia and hydrogen sulfide and a water phase containing the separated ammonia and hydrogen sulfide. The water phase, containing ammonia and hydrogen sulfide, passes from water washing system 38 and separation zone 42 through line 44.

The scrubbed second reactor effluent passes from separation zone 42 through line 48 and is introduced into first separation zone 50. First separator 52 defines first separation zone 50 and provides means for separating the scrubbed second reactor effluent into a first separator vapor and a first separator liquid.

The first separator vapor passes from first separation zone 50 by way of line 54, and the first separator liquid passes from first separation zone 50 through line 56 and is introduced as a feed into fractionation (distillation) zone 58 of fractionation column 60. Fractionation column 60 provides means for distilling the first separator liquid to yield a heavy bottoms product and one or more other products that include the final diesel product of the two-stage hydrocracking process 10. The diesel product is recovered and passes from fractionation (distillation) zone 58 through line 62. Other products such as kerosene, naphtha and light hydrocarbons may be recovered and pass from distillation zone 58 respectively through lines 64, 66 and 68.

A heavy bottoms product passes from distillation zone 58 of main fractionation column 60 through line 70 and is introduced as a feed into third reaction zone 74 of third reactor 76. A nitrogen-containing compound passing through line 77 is admixed with the heavy bottoms product before its introduction into third reaction zone 74.

Third reactor 76 defines third reaction zone 74 having upper portion 78 and a lower portion 80. Upper portion 78 includes top bed 82 containing second pretreating catalyst 84 and bottom bed 86 containing second hydrocracking catalyst 88. Third reaction zone 74 is operated under reaction conditions suitable to provide desired yields and quality of the final diesel product of the two-stage hydrocracking process 10.

Hydrocracking reaction temperature conditions within bottom bed 86 may further be controlled by passing quench gas, comprising hydrogen, through line 89 and introducing it into third reaction zone 74. The control of bottom bed 86 reaction temperature provides for additional control of the diesel selectivity of the cracking reaction.

A third reactor effluent passes from third reaction zone 74 through line 90 and is introduced into second separation zone 94 that is defined by second separator 96. Second separator 96 provides means for separating the third reactor effluent into a second separator vapor and a second separator liquid. The second separator vapor passes from second separation zone 94 by way of line 98

The second separator liquid is recycled by way of line 100 and introduced as feed to the fractionation zone 58 of fractionation column 60. In an alternative embodiment, the second separator liquid is instead recycled through line 102 and introduced as feed to third reaction zone 74 of third reactor 76. In still another alternative, a portion of the second separator liquid passes through line 100 and is introduced into fractionation zone 58 of fractionation column 60, and a separate portion of the second separator liquid is recycled through line 102 and introduced as a feed into third reaction zone 74 of third reactor 76.

That which is claimed:

1. A hydrocracking process for converting a light gas oil feedstock to produce a diesel product, wherein the hydrocracking process comprises:

introducing the light gas oil feedstock into a first reaction zone defined by a first reactor and containing a first pretreating catalyst, wherein the light gas oil feedstock has an initial boiling temperature greater than 135° C. (275° F.), a final boiling temperature less than 440° C. (824° F.), and characterized as having a T10 of greater than 150° C. (302° F.) and a T90 of 400° C. (752° F.) or less;

yielding from the first reaction zone a first reactor effluent;

introducing the first reactor effluent into a second reaction zone defined by a second reactor and containing a first hydrocracking catalyst;

yielding from the second reaction zone a second reactor effluent;

introducing the second reactor effluent into a first separation zone defined by a first separator vessel providing means for separating the second reactor effluent into a first separator vapor and a first separator liquid;

introducing the first separator liquid into a fractionator providing for distillation separation of the first separator liquid to yield at least a bottoms product and another product;

introducing the bottoms product into a third reaction zone defined by a third reactor, wherein within the third reaction zone is included a top bed having a top bed volume and comprising a second pretreating catalyst and a bottom bed having a bottom bed volume and comprising a second hydrocracking catalyst, wherein the ratio of top bed volume-to-bottom bed volume is in the range of from 0.1:1 to 1.5:1, wherein the second hydrocracking catalyst comprises less than 60 wt.% amorphous alumina, greater than 30 wt.% crystalline zeolite, from 1 to 10 wt.% nickel or cobalt, and from 5 to 25 wt.% tungsten or molybdenum and wherein the third reaction zone has a cracking temperature, and admixing a nitrogen-containing compound with the bottoms product before its introduction into the third reaction zone;

yielding from the third reaction zone a third reactor effluent;

introducing the third reactor effluent into a second separation zone defined by a second separator vessel providing means for separating the third reactor effluent into a second separator vapor and a second separator liquid; and introducing the second separator liquid into the fractionator, or introducing the second separator liquid as feed to the third reaction zone, or introducing a portion of the second separator liquid into the fractionator and a separate portion of the second separator liquid as a feed to the third reaction zone.

2. The hydrocracking process as recited in claim 1, wherein the light gas oil feedstock is characterized as having a nitrogen content in the range of from 500 to 10,000 ppmw, and a sulfur content in the range of from 0.01% to 5% by weight.

3. The hydrocracking process as recited in claim 1, further comprising:

admixing with the bottoms product an effective amount of a nitrogen-containing compound to modify cracking activity of the second hydrocracking catalyst to enhance its diesel selectivity.

4. The hydrocracking process as recited in claim 1, further comprising:

introducing quench gas into the third reaction zone to control diesel selectivity of the cracking reaction by controlling the cracking reaction temperature within the bottom bed of the third reaction zone.

5. The hydrocracking process as recited in claim 4, wherein the second hydrocracking catalyst comprises less than 50 weight percent amorphous alumina.

6. The hydrocracking process as recited in claim 5, wherein the light gas oil feedstock is characterized as having a nitrogen content in the range of from 500 to 10,000 ppmw, and a sulfur content in the range of from 0.01% to 5% by weight.

7. The hydrocracking process as recited in claim 6, further comprising:

admixing with the bottoms product an effective amount of a nitrogen-containing compound so to modify cracking activity of the second hydrocracking catalyst to enhance its diesel selectivity.

8. The hydrocracking process as recited in claim 4, further comprising:

admixing with the bottoms product an effective amount of a nitrogen-containing compound to modify cracking activity of the second hydrocracking catalyst to enhance its diesel selectivity.

9. The hydrocracking process as recited in claim 1, further comprising:

admixing with the first reactor effluent an effective amount of a nitrogen-containing compound to modify the cracking activity of the first hydrocracking catalyst to enhance its diesel selectivity.

10. The hydrocracking process as recited in claim 9, wherein the nitrogen-containing compound is selected from the group consisting of ammonia and organic amine compounds capable of conversion to ammonia under the conditions within the third reaction zone.

* * * * *